US008699927B2

(12) United States Patent
Nishizawa

(10) Patent No.: US 8,699,927 B2
(45) Date of Patent: Apr. 15, 2014

(54) DEVELOPMENT DEVICE AND IMAGE FORMING APPARATUS

(75) Inventor: Katsuyuki Nishizawa, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 326 days.

(21) Appl. No.: 13/164,314

(22) Filed: Jun. 20, 2011

(65) Prior Publication Data

US 2012/0099906 A1 Apr. 26, 2012

(30) Foreign Application Priority Data

Oct. 25, 2010 (JP) ..... 2010-238480

(51) Int. Cl.
*G03G 15/08* (2006.01)

(52) U.S. Cl.
USPC ..... 399/284

(58) Field of Classification Search
USPC ..... 399/284, 274
See application file for complete search history.

(56) References Cited

U.S. PATENT DOCUMENTS

| | | | | |
|---|---|---|---|---|
| 7,250,240 | B2 * | 7/2007 | Tosaka et al. | 430/108.1 |
| 2004/0120734 | A1 | 6/2004 | Okamoto | |
| 2005/0185980 | A1 * | 8/2005 | Okamoto | 399/103 |
| 2009/0003890 | A1 * | 1/2009 | Lee et al. | 399/284 |

FOREIGN PATENT DOCUMENTS

JP 2004-86059 A 3/2004

* cited by examiner

*Primary Examiner* — Sandra Brase
(74) *Attorney, Agent, or Firm* — Sughrue Mion, PLLC

(57) ABSTRACT

A development device includes: a development roller that includes a cylindrical member and a shaft, which cylindrical member has a hollow portion through which the shaft is inserted, and is rotated around an axis, holding a developer containing a toner on a surface of the cylindrical member to supply the toner to an image holder; a rod-shaped regulation member that is disposed approximately in parallel with the development roller, and regulates a thickness of the toner held on the surface of the cylindrical member; a first supporting member that supports an end of the shaft of the development roller and an end of the regulation member; and a second supporting member that supports another end of the shaft of the development roller and another end of the regulation member.

17 Claims, 9 Drawing Sheets

DEVELOPMENT DEVICE AND IMAGE FORMING APPARATUS

CROSS-REFERENCE TO RELATED APPLICATIONS

This application is based on and claims priority under 35 U.S.C. 119 from Japanese Patent Application No. 2010-238480 filed on Oct. 25, 2010.

BACKGROUND

1. Technical Field

The present invention relates to a development device and an image-forming apparatus.

2. Related Art

In some development devices, a development roller and a regulation blade are provided for developing a latent image formed on a photoconductor. The regulation blade is disposed at a position facing the development roller by a supporting member. The regulation blade controls the thickness of a toner held on the development roller.

SUMMARY

According to an aspect of the invention, there is provided a development device including: a development roller that includes a cylindrical member and a shaft, which cylindrical member has a hollow portion through which the shaft is inserted, and is rotated around an axis, holding a developer containing a toner on a surface of the cylindrical member to supply the toner to an image holder; a rod-shaped regulation member that is disposed approximately in parallel with the development roller, and regulates a thickness of the toner held on the surface of the cylindrical member; a first supporting member that supports an end of the shaft of the development roller and an end of the regulation member; and a second supporting member that supports another end of the shaft of the development roller and another end of the regulation member.

BRIEF DESCRIPTION OF THE DRAWINGS

Exemplary embodiments of the present invention will be described in detail based on the following figures, wherein.

DETAILED DESCRIPTION

Figure 1:
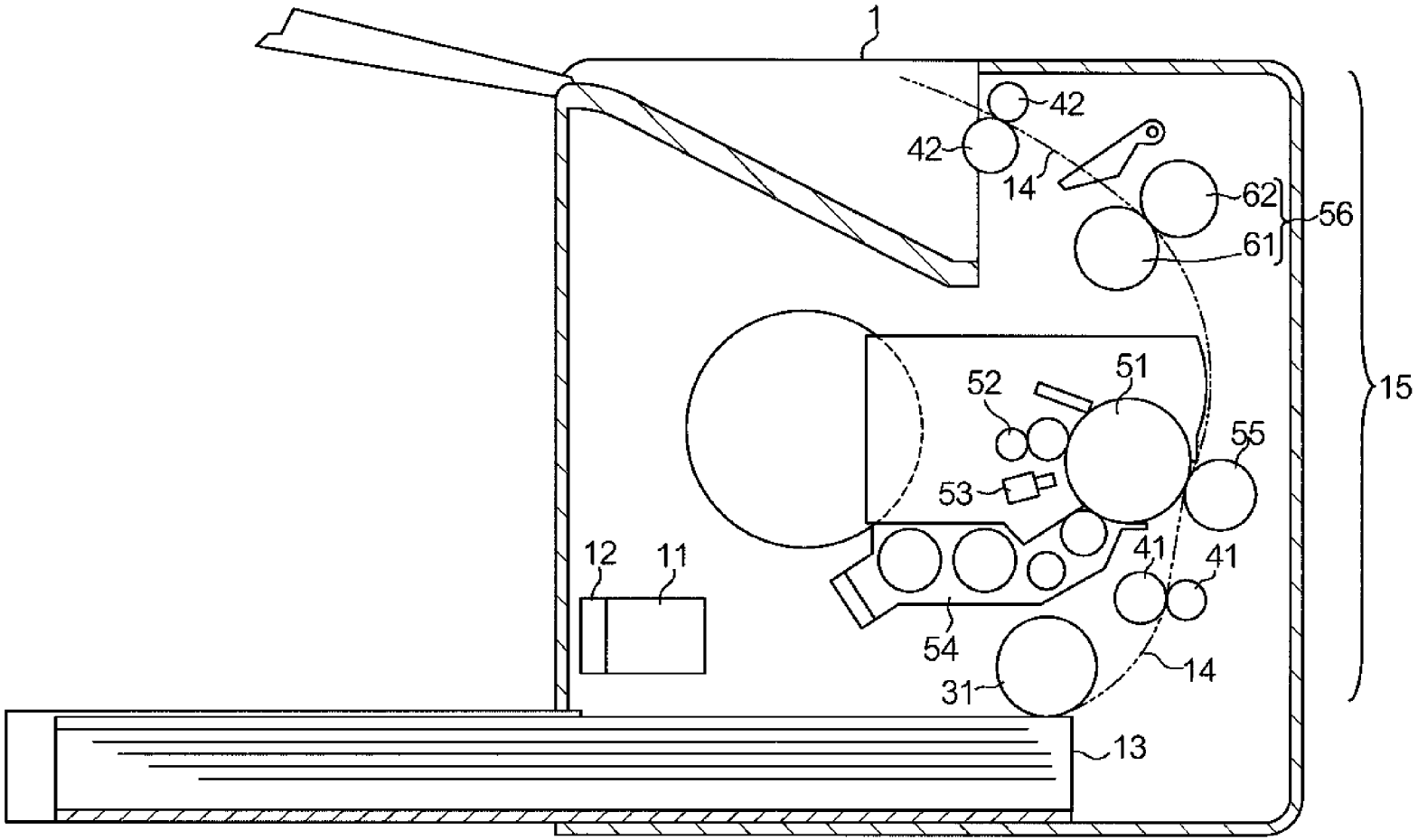
FIG. 1 is a schematic diagram showing a configuration of image-forming apparatus 1.

FIG. 1 is a schematic diagram showing a configuration of image-forming apparatus 1 according to the present exemplary embodiment. Image-forming apparatus 1 includes controller 11, communication unit 12, paper supply unit 13, transport unit 14, and image-forming unit 15. Controller 11 includes a Central Processing Unit (CPU) and a memory. Controller 11 controls each component of image-forming apparatus 1 by execution of a program stored in the memory by the CPU. Communication unit 12 performs data communication with a computer device via a communication line. For example, controller 11 receives image data from a computer device via communication unit 12. Paper supply unit 13 contains plural recording mediums. Paper supply unit 13 includes paper supply roller 31. Paper supply roller 31 sends a single recording medium from paper supply unit 13. Transport unit 14 transports the recording medium from paper supply unit 13 to the outside of image-forming apparatus 1 via image-forming unit 15. Transport unit 14 includes transport rollers 41 and paper exit rollers 42. Transport rollers 41 receive a recording medium from paper supply unit 13, and transport the recording medium at such timing that a toner image is transferred onto the recording medium. Paper exit rollers 42 receive a recording medium passed through image-forming unit 15, and cause the recording medium to exit from image-forming apparatus 1.

Image-forming unit 15 includes photoconductive drum 51, charging device 52, exposure device 53, development device 54, primary transfer roller 55, and fuser device 56. Photoconductive drum 51 (an example of an image holder) is of a cylindrical shape. Photoconductive drum 51 is caused to rotate by a drive unit such as a motor (not shown). Charging device 52 (an example of a charging unit) uniformly charges the surface of photoconductive drum 51 to a predetermined potential. Exposure device 53 (an example of an exposure unit) irradiates the surface of charged photoconductive drum 51 with a laser beam to form an electrostatic latent image. When irradiating photoconductive drum 51, exposure device 53 modulates a laser beam based on image data received from a computer device. Developing device 54 develops an electrostatic latent image formed on photoconductive drum 51 with a toner to form a toner image. Primary transfer roller 55 (an example of a transfer unit) transfers a toner image formed on photoconductive drum 51 onto a recording medium (e.g., a paper) transported by transport rollers 41. Fuser device 56 (an example of a fixing unit) includes heat roller 61 and pressure roller 62. Fuser device 56 applies heat and pressure to a toner image formed on a recording medium to fix the toner image to the recording medium. After passing fuser device 56, a recording medium is exited from image-forming apparatus 1 by paper exit rollers 42.

Figure 2:
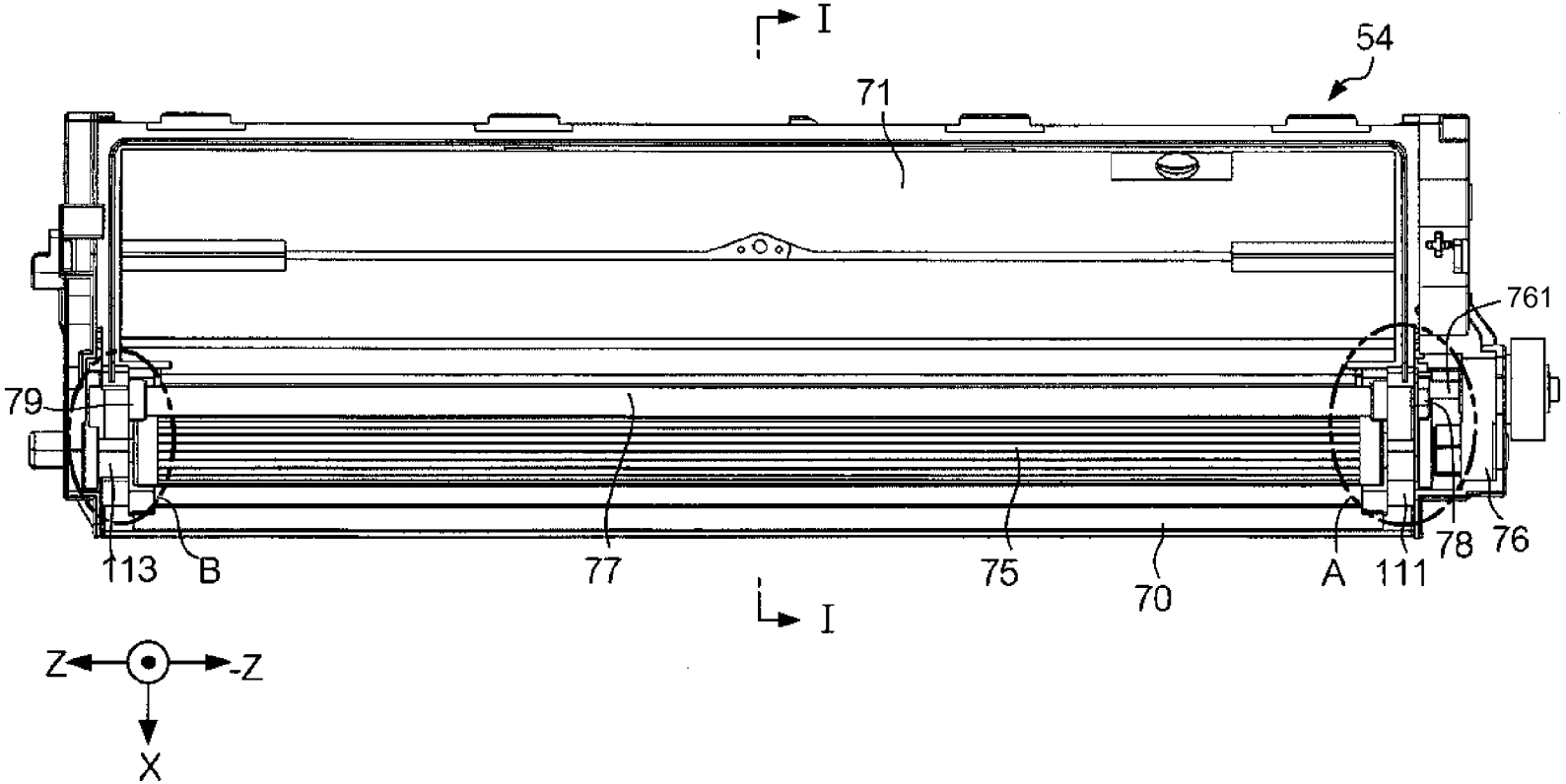
FIG. 2 is a plane view of development device 54.
Figure 3:
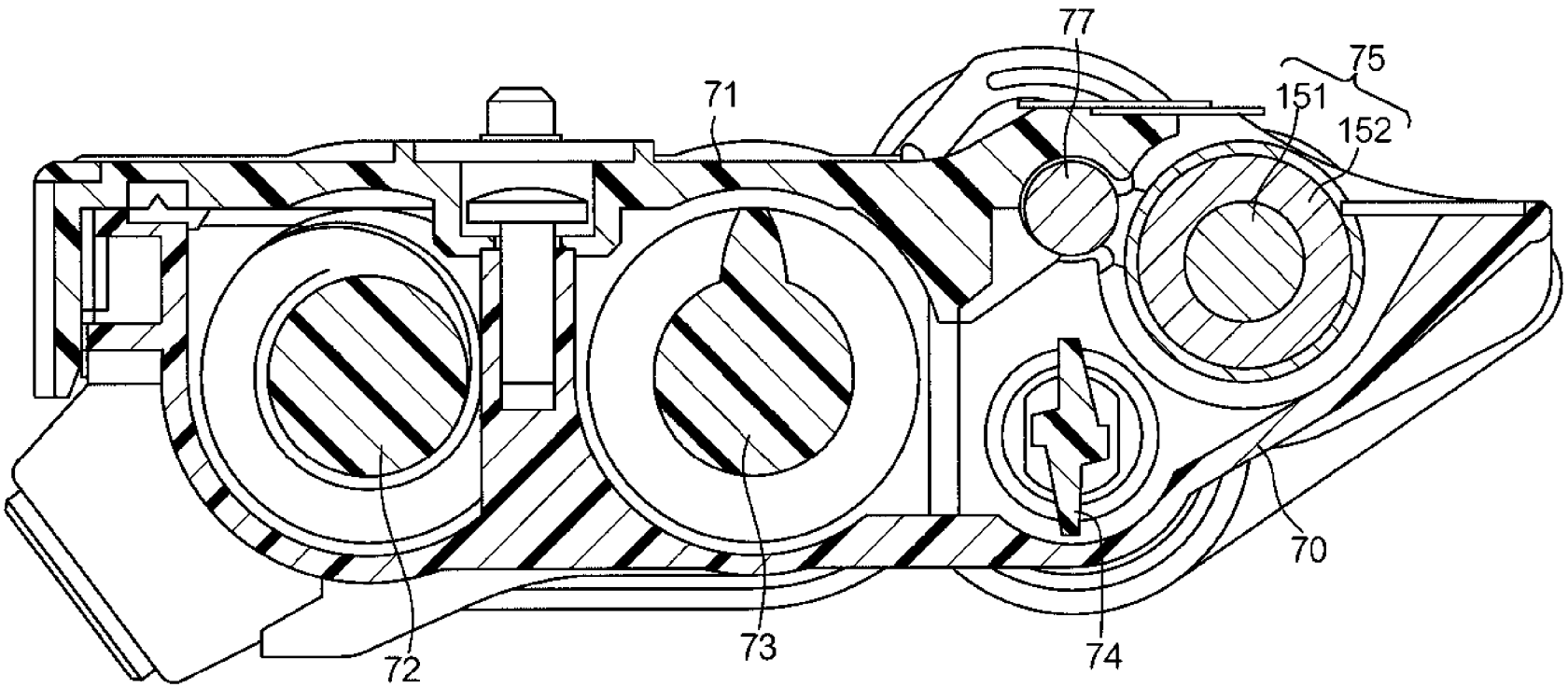
FIG. 3 is a cross-section view of development device 54 taken along line I-I of FIG. 2.

FIG. 2 is a plain view of development device 54. FIG. 3 is a cross-sectional view of development device 54 taken along line I-I of FIG. 2. Development device 54 includes housing 70 and cover 71. Housing 70 contains a developer containing a toner. The toner is supplied from a toner supply unit (not shown). Cover 71 covers housing 70 from above. Housing 70 and cover 71 are formed of ABS resin. Inside housing 70, conveyance members 72 and 73, supply member 74, development roller 75, input gear 76, regulation member 77, and supporting members 78 and 79 are provided.

Conveyance members 72 and 73 convey a developer contained in housing 70 to supply member 74 while agitating the developer. Supply member 74 supplies the conveyed developer to developer roller 75. Developer roller 75 includes shaft 151 and cylindrical member 152. Cylindrical member 152 has a hollow portion through which shaft 151 is inserted. Developer roller 75 is caused to rotate around an axis by a drive unit (not shown), such as a motor, via input gear 76. When a developer is supplied from supply member 74, developer roller 75 holds the developer on the surface of cylindrical member 152. The developer held on cylindrical member 152 is conveyed to a position facing photoconductive drum 51 by rotation of development roller 75. When the developer is conveyed to the position, a toner contained in the developer moves and adheres to an electrostatic latent image, formed on photoconductive drum 51. In this manner, development roller 75 supplies a toner to an electrostatic latent image formed on photoconductive drum 51. Input gear 76 (an example of a transmission unit) includes shaft 761. Input gear 76 is caused to rotate around an axis by a drive unit, thereby transmitting torque of a drive unit (not shown) to development roller 75 to rotate development roller 75. Regulation member 77 is a solid cylindrical rod. Regulation member 77 is disposed in the axial direction of development roller 75 approximately in parallel with development roller 75. Regulation member 77 is made of a magnetic material. Regulation member 77 is spaced apart from cylindrical member 152, maintaining a certain distance. Regulation member 77 regulates the thickness of a toner held on cylindrical member 152. "Regulation" refers to controlling the thickness of a toner to a predetermined thickness. Supporting member 78 supports all of an end of shaft 151 of development roller 75, an end of regulation member 77, and an end of shaft 761 of input gear 76. Supporting member 79 supports both the other end of shaft 151 of development roller 75, and the other end of regulation member 77.

Figure 4:
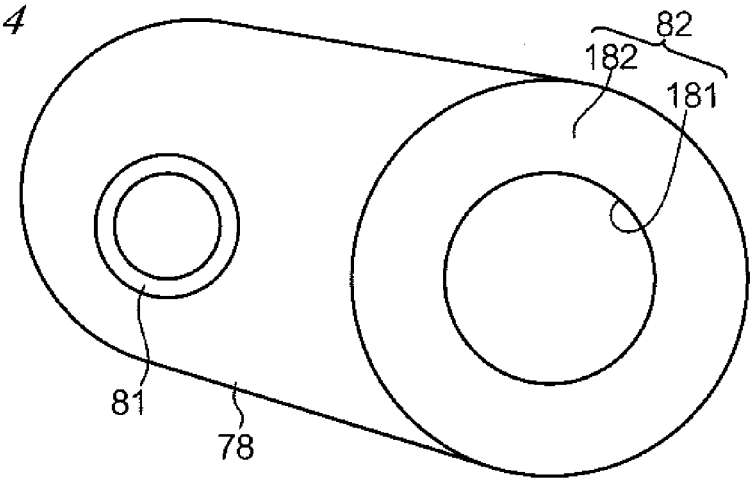
FIG. 4 is a front view of supporting member 78.
Figure 5:
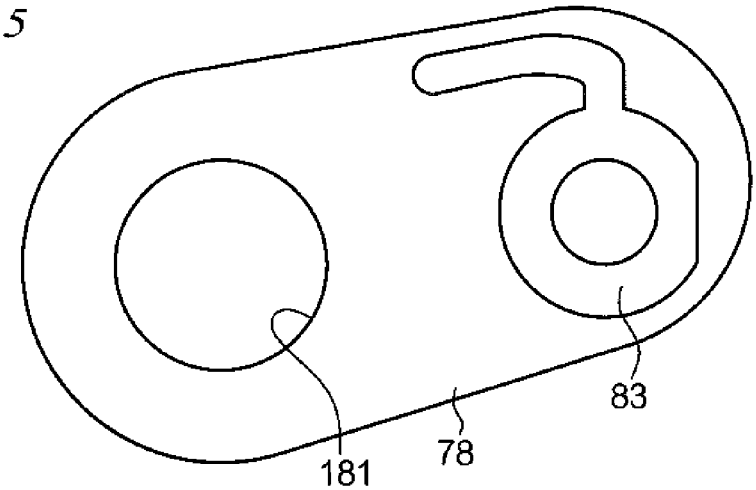
FIG. 5 is a back view of supporting member 78.
Figure 6:
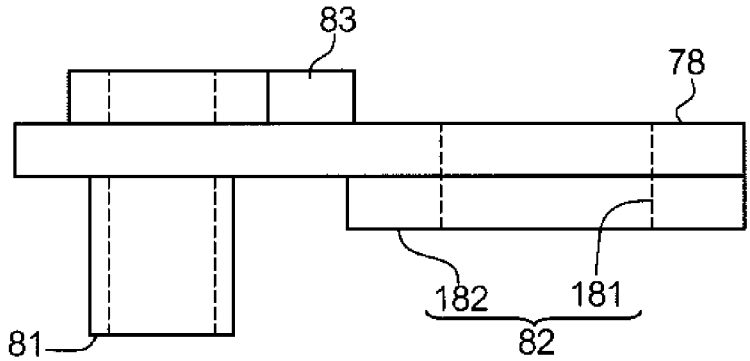
FIG. 6 is a plane view of supporting member 78.

FIG. 4 is a front view of supporting member 78. On the front surface of supporting member 78, holding unit 81 and bearing 82 are provided. Holding member 81 is of a tubular shape. An end of regulation member 77 is inserted into holding member 81 thereby the end is fixed. Bearing 82 includes hole 181 and flange 182. Hole 181 penetrates through supporting member 78 from the front surface to the back surface. An end of shaft 151 of development roller 75 is inserted through hole 181 of bearing 82, thereby the end is rotatably supported. FIG. 5 is a back view of supporting member 78. On the back surface of supporting member 78, holding member 83 is provided. Holding member 83 is of a tubular shape. An end of shaft 761 of input gear 76 is inserted into holding member 83 thereby the end is fixed. FIG. 6 is a plane view of supporting member 78. As is shown in FIG. 6, holding member 81 and bearing 82 protrude from the front surface of supporting member 78, and holding member 83 protrudes from the back surface of supporting member 78. In addition, holding member 81 and holding member 83 are disposed on partially overlapping areas of the front and back of supporting member 78. This increases intensity of supporting member 78 with respect to the axial direction, and makes it more difficult for supporting member 78 to bend.

Figure 7:
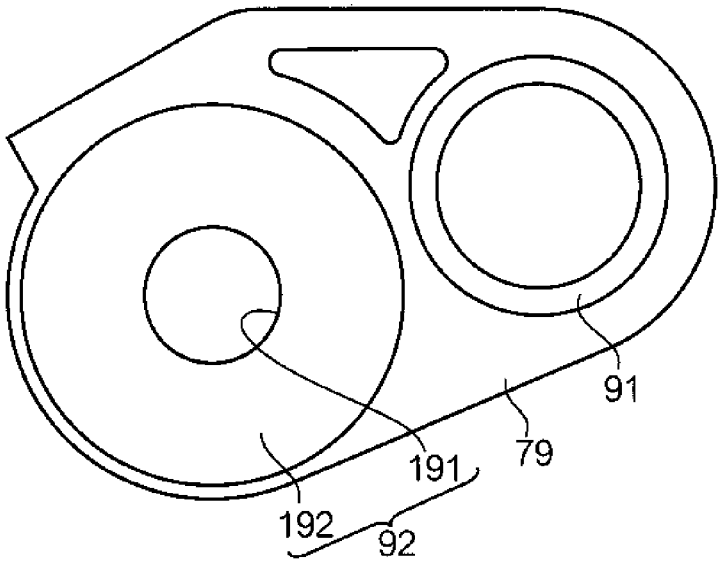
FIG. 7 is a front view of supporting member 79.
Figure 8:
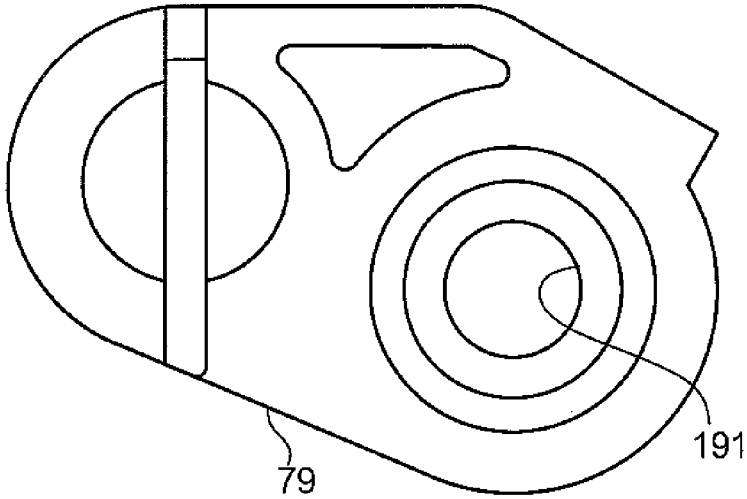
FIG. 8 is a back view of supporting member 79.
Figure 9:
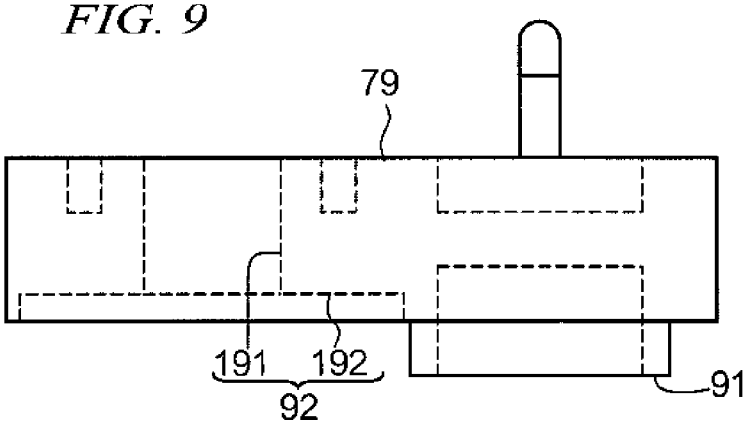
FIG. 9 is a plane view of supporting member 79.

FIG. 7 is a front view of supporting member 79. On the front surface of supporting member 79, holding unit 91 and bearing 92 are provided. Holding unit 91 is of a tubular shape. The other end of regulation member 77 is inserted into holding unit 91 thereby the other end is fixed. Bearing 92 includes hole 191 and flange 192. Hole 191 penetrates through supporting member 79 from the front surface to the back surface. The other end of shaft 151 of development roller 75 is inserted through hole 191 of bearing 92, thereby the other end is rotatably supported. FIG. 8 is a back view of supporting member 79. FIG. 9 is a plane view of supporting member 79. As is shown in FIG. 9, holding member 91 protrudes from the front surface of supporting member 79.

Supporting members 78 and 79 are formed of polyacetal (POM). The polyacetal is a material with high resistance to fatigue, a low coefficient of friction, and a slip property. Also, the polyacetal has elasticity and rigidity higher than ABS resin, which forms housing 70 and cover 71. If supporting members 78 and 79 are formed of ABS resin, the inner sides of holding members 81 and 91 are likely to be deformed when ends of regulation member 77 are inserted into holding members 81 and 91. When the inner sides of holding members 81 and 91 are deformed, regulation member 77, whose ends are inserted into the holding members 81 and 91, inclines to development roller 75. However, in the present exemplary embodiment, supporting members 78 and 79 are formed of polyacetal. Therefore, the inner sides of holding members 81 and 91 are barely deformed. Accordingly, it is possible to prevent regulation member 77 from inclining. For the same reason, the inner sides of bearings 82, 92, and holding member 83 are barely deformed. Accordingly, it is possible to prevent shaft 151 of development roller 75 and shaft 761 of input gear 76 from inclining. Also, in the present exemplary embodiment, supporting members 78 and 79 are formed of polyacetal with a low coefficient of friction. Therefore, slide resistance per unit area of input gear 76 is reduced.

To control uniformly the thickness of a toner, an approximately constant distance may be maintained between cylindrical member 152 and regulation member 77 in the axial direction of development roller 75. However, if shaft 151 of development roller 75, and regulation member 77 are supported by different members, it is difficult to position cylindrical member 152 and regulation member 77 so as to maintain a constant distance between cylindrical member 152 and regulation member 77. However, in the present exemplary embodiment, shaft 151 of development roller 75, and regulation member 77 are supported by the same supporting members 78 and 79. Therefore, positioning accuracy of development roller 75 and regulation member 77 is improved. Accordingly, it is possible to maintain an approximately constant distance between cylindrical member 152 and regulation member 77. In addition, more space-saving is accomplished than in a case of a configuration in which shaft 151 of development roller 75, and regulation member 77 are supported by different members. Further, in the present exemplary embodiment, regulation member 77 is of a cylindrical shape. Therefore, an angle of regulation member 77 does not have to be adjusted when positioning regulation member 77. Furthermore, in the present exemplary embodiment, when regulation member 77 is fixed, both ends of regulation member 77 are inserted into respective holding units 81 and 91. Therefore, a fastener member such as a screw is not required for fixing regulation member 77. Thus, shifting a position of regulation member 77 caused by the fastener member coming loose, is prevented.

Figure 10:
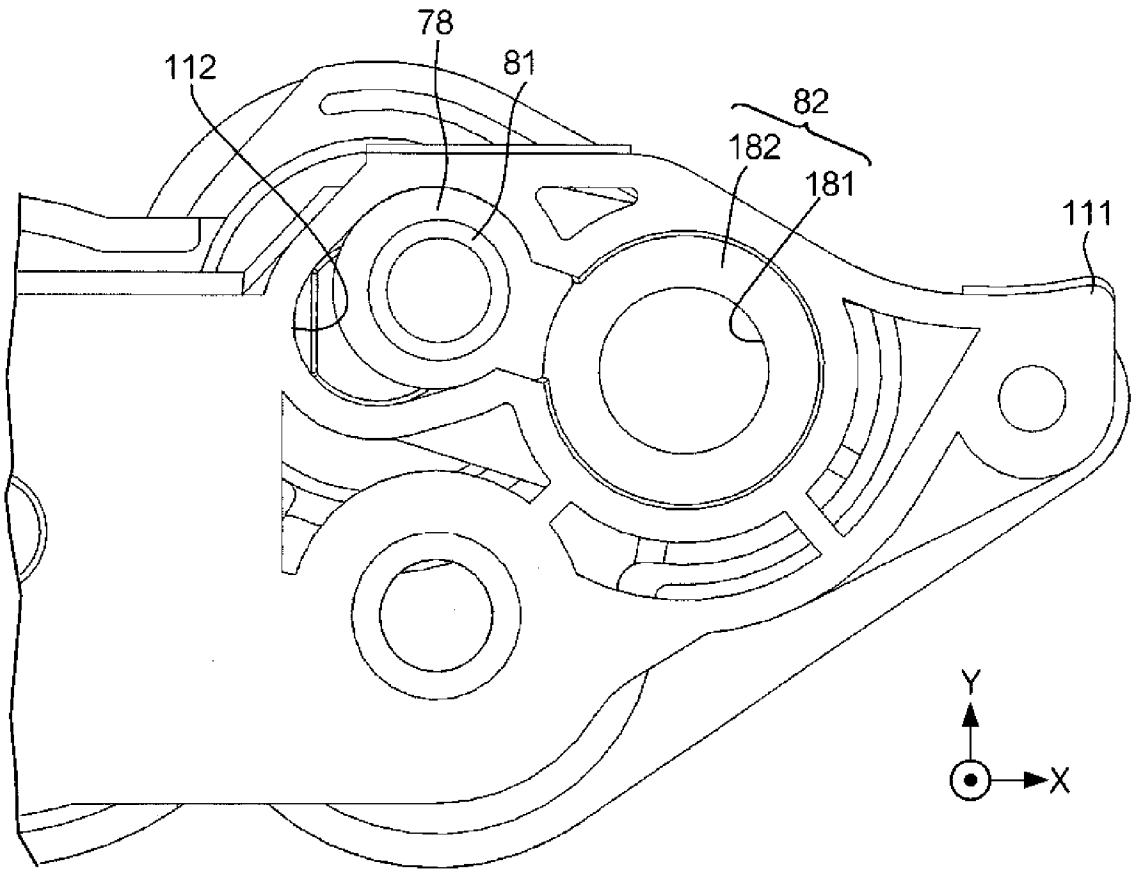
FIG. 10 is a view of part A of FIG. 2 viewed in −Z direction.
Figure 11:
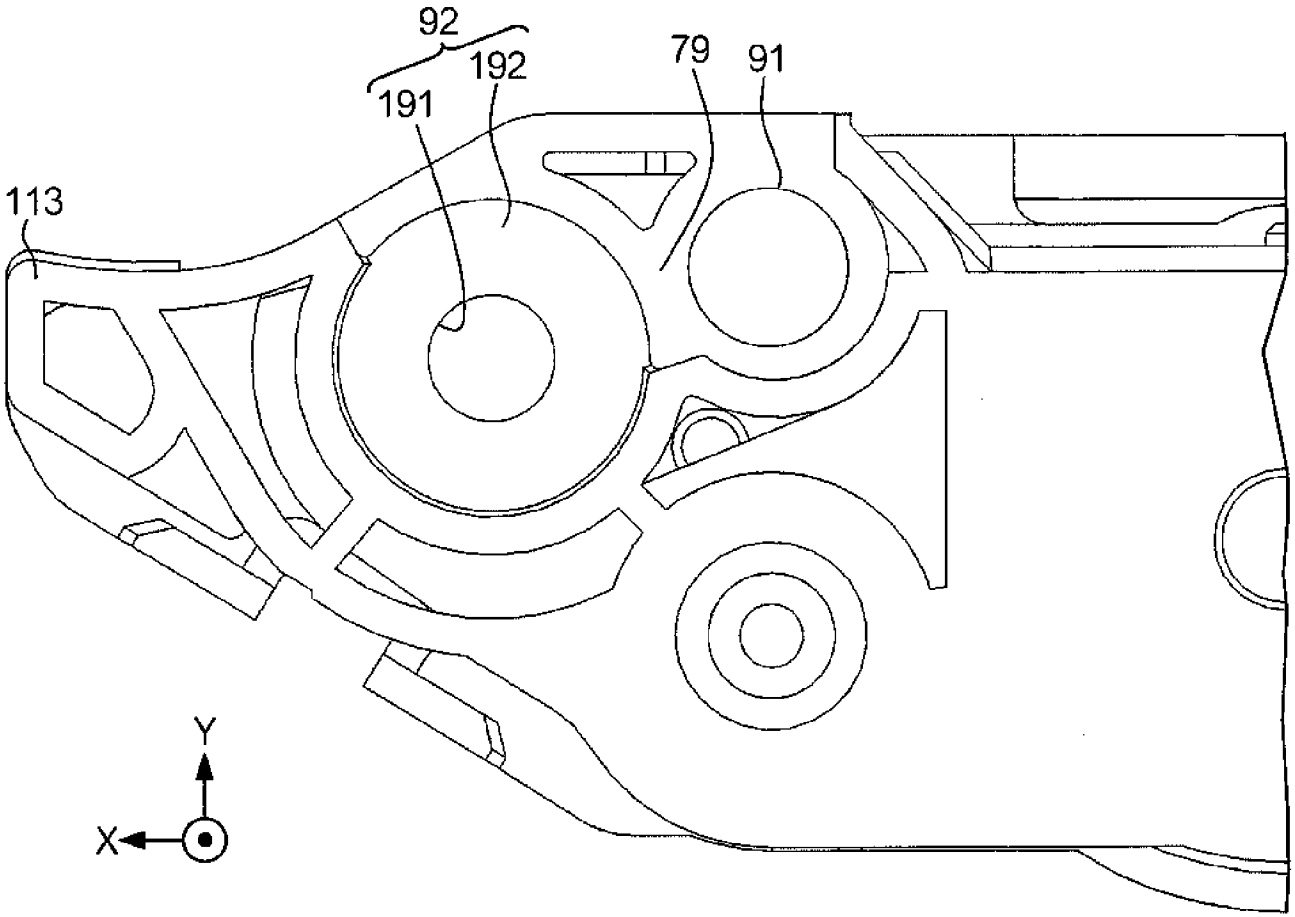
FIG. 11 is a view of part B of FIG. 2 viewed in Z direction.

FIG. 10 is a view of part A of FIG. 2 viewed in −Z direction. It is to be noted that in FIG. 10, development roller 75, regulation member 77, and housing 70 shown in FIG. 2 are omitted. Housing 70 contains wall 111 between cylindrical member 152 and supporting member 78. On wall 111, hole 112 is formed in areas facing holding member 81, bearing 82, and a space between holding member 81 and bearing 82. In other words, wall 111 includes a cut out portion in an area through which an end of shaft 151 of development roller 75 passes (an example of a first area), an area through which an end of regulation member 77 passes (an example of a second area), and an area therebetween. FIG. 11 is a view of part B of FIG. 2 viewed in Z direction. It is to be noted that in FIG. 11, development roller 75, regulation member 77, and housing 70 shown in FIG. 2 are omitted. Housing 70 contains wall 113 between cylindrical member 152 and supporting member 79. Wall 113 is not provided in areas facing holding member 91, bearing 92, and a space between holding member 91 and bearing 92. In other words, wall 113 includes a cut out portion in an area through which the other end of shaft 151 of development roller 75 passes (an example of the third area), an area through which the other end of regulation member 77 passes (an example of the fourth area), and an area therebetween. The reason why each of wall 111 and 113 is not provided in a space between an area through which shaft 151 of development roller 75 passes and an area through which regulation member 77 passes is as described below.

For example, it may be necessary to change the thickness of a toner held on cylindrical member 152 in a design phase. In this case, it is possible to change a distance between cylindrical member 152 and regulation member 77 by using both supporting member 78 that has holding member 81 and bearing 82 spaced apart by a changed distance, and supporting member 79 that has holding member 91 and bearing 92 spaced apart by a changed distance, without changing the shape of housing 70. However, in a case where a distance between cylindrical member 152 and regulation member 77 is shortened, if each of the walls 111 and 113 is provided in a space between an area through which shaft 151 of development roller 75 passes and an area through which regulation member 77 passes, walls 111 and 113 block areas through which shaft 151 of development roller 75, and regulation member 77 will pass. To expand a range of distance to be changed between cylindrical member 152 and regulation member 77, each of walls 111 and 113 is not provided in a space between an area through which shaft 151 of development roller 75 passes and an area through which regulation member 77 passes.

Figure 13:
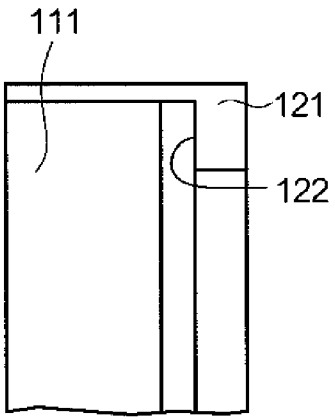
FIG. 13 is a magnified view schematically showing part C of FIG. 12 viewed in −X direction.
Figure 12:
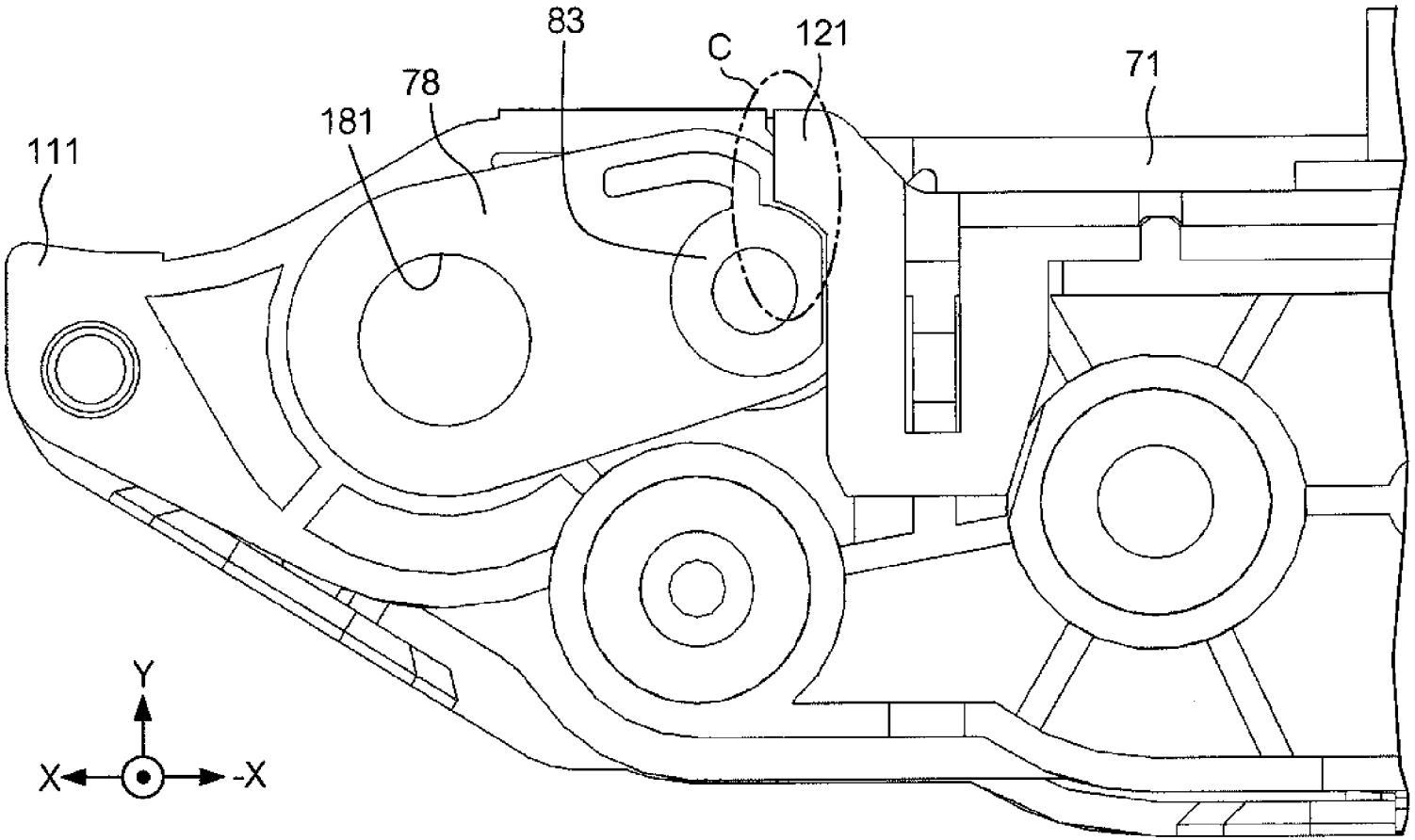
FIG. 12 is a view of part A of FIG. 2 viewed in Z direction.
Figure 14:
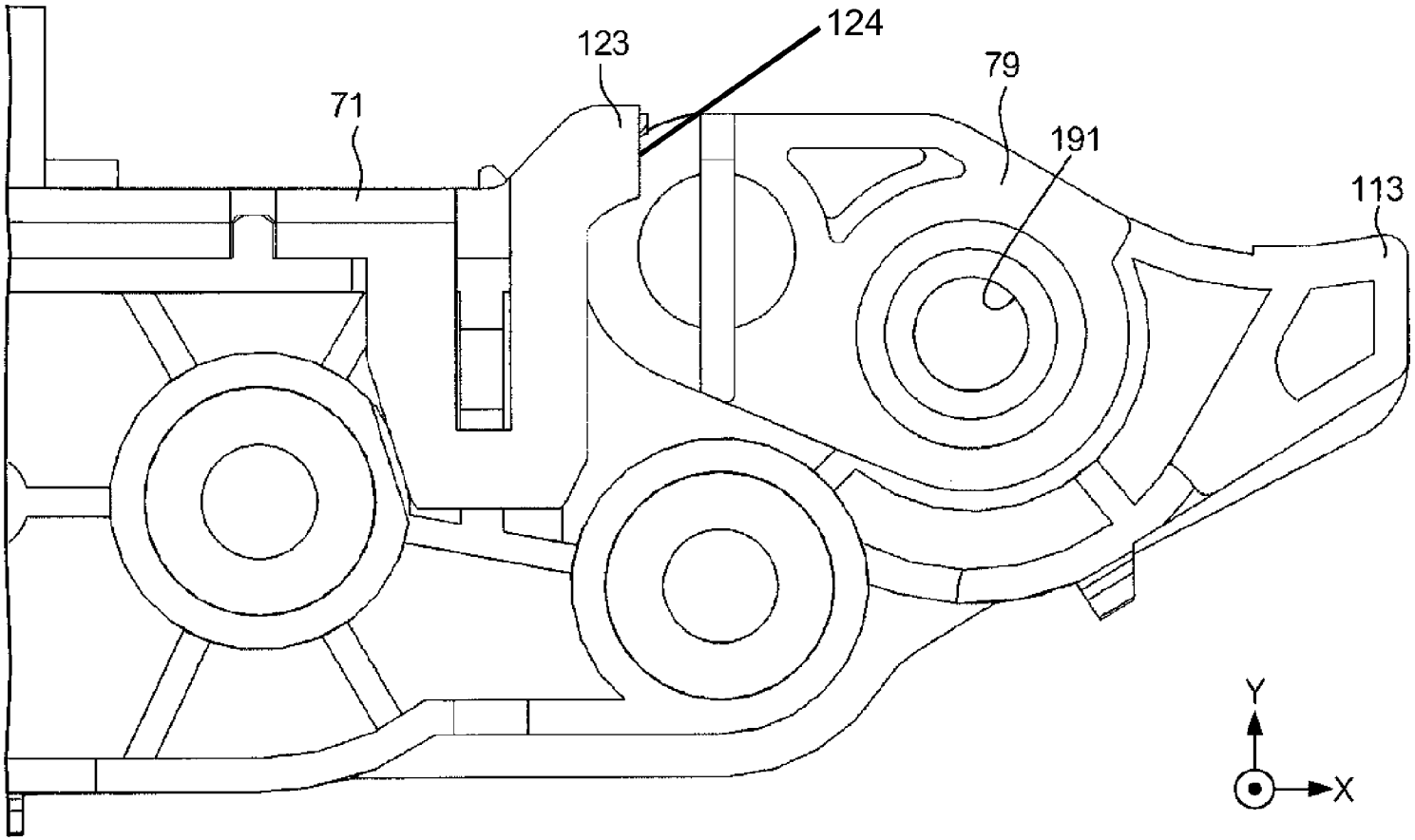
FIG. 14 is a view of part B of FIG. 2 viewed in −Z direction.

FIG. 12 is a view of part A of FIG. 2 viewed in Z direction. It is to be noted that in FIG. 12, development roller 75, input gear 76 and housing 70 shown in FIG. 2 are omitted. On cover 71, protruding member 121 (an example of the first protruding member) is provided. Protruding member 121 protrudes downward from the cover 71. FIG. 13 is a magnified view schematically showing part C of FIG. 12 viewed in –X direction. It is to be noted that in FIG. 13, supporting member 78 shown in FIG. 12 is omitted. Protruding member 121 and wall 111 form gap 122 (an example of the first gap). Supporting member 78 is inserted into gap 122 thereby supporting member 78 is fixed to prevent it from coming off in the axial direction although a fastener member such as a screw is not used. FIG. 14 is a view of part B of FIG. 2 viewed in –Z direction. As a structure of a supporting member 78 side, protruding member 123 (an example of the second protruding member) protrudes downward from cover 71, and protruding member 123 and wall 113 form gap 124 (an example of the second gap). Supporting member 79 is inserted into gap 124; thereby supporting member 79 is fixed so as to prevent it from coming off in the axial direction.

Modifications

The present invention is not limited to the above exemplary embodiment. The present invention may be implemented in the embodiment modified as described below. Also, the following modifications may be combined with each other.

In the exemplary embodiment, regulation member 77 is of a cylindrical shape. However, a shape of regulation member 77 is not limited to the shape if regulation member 77 is of a rod shape. For example, regulation member 77 is of a rod shape having a sector cross-section. In this case, regulation member 77 is disposed such that the sector surface of regulation member 77 faces development roller 75.

Supporting members 78 and 79 may be formed of a material other than polyacetal. However, it may be that supporting members 78 and 79 are formed of a material with a slip property, elasticity, and rigidity, which are higher than ABS resin.

Supporting member 78 does not have to include holding member 83 that supports shaft 761 of input gear 76. In this case, a member for supporting shaft 761 of input gear 76 is provided separately from supporting member 78.

Supporting member 78, holding member 81, flange 182 and holding member 83 may be integrally molded, or may be connected after those members are molded as separate bodies. Similarly, supporting member 79 and holding member 91 may be integrally molded, or may be connected after those members are molded as separate bodies.

Image-forming apparatus 1 may form plural colors of an image. In this case, image-forming apparatus 1 includes photoconductive drum 51, charging device 52, exposure device 53, development device 54, and primary transfer roller 55 for each color. Also, image-forming unit 15 may form an image on a recording medium other than paper, such as a viewgraph.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiments have been chosen and described so that the principles of the invention and its practical applications are explained best; thereby enabling persons skilled in the art to understand the invention for use with various embodiments and with various modifications as suited to a particular use contemplated. It is intended that the scope of the invention be defined by the following claims and their equivalents.

What is claimed is:

1. A development device comprising:

a development roller that includes a cylindrical member and a shaft, which cylindrical member has a hollow portion through which the shaft is inserted, and the development roller is rotated around an axis, holding a developer containing a toner on a surface of the cylindrical member to supply the toner to an image holder;

a regulation member that is disposed approximately in parallel with the development roller, and regulates a thickness of the toner held on the surface of the cylindrical member;

a first supporting member that supports an end of the shaft of the development roller and an end of the regulation member, wherein the first supporting member is removable from the development device, the first supporting member includes a single member supporting the end of the shaft of the development roller and the end of the regulation member; and a second supporting member that supports another end of the shaft of the development roller and another end of the regulation member, wherein the second supporting member is removable from the development device, the second supporting member includes another single member supporting the other end of the shaft of the development roller and the other end of the regulation member.

2. The development device according to claim 1, further comprising:

a transmission unit that includes a shaft, and transmits, by rotating around an axis, torque supplied from a drive unit to the development roller to rotate the development roller, wherein the first supporting member supports an end of the shaft of the transmission unit.

3. The development device according to claim 2, further comprising:

a housing that contains the development roller, the regulation member, the first supporting member, the second supporting member, and the transmission unit;

a first wall that is provided between the cylindrical member and the first supporting member in the housing; and a second wall that is provided between the cylindrical member and the second supporting member in the housing, wherein:

the first wall includes a cut out portion in a first area through which the end of the shaft of the development roller passes, a second area through which the end of the regulation member passes, and a space between the first area and the second area; and the second wall includes a cut out portion in a third area through which the other end of the shaft of the development roller passes, a fourth area through which the other end of the regulation member passes, and a space between the third area and the fourth area.

4. The development device according to claim 3, further comprising:

a cover that covers the housing from above;

a first protruding unit that protrudes downward from the cover to form a first gap between the first wall and the first protruding unit; and a second protruding unit that protrudes downward from the cover to form a second gap between the second wall and the second protruding unit, wherein:

the first supporting member is inserted into the first gap; and the second supporting member is inserted into the second gap.

5. The development device according to claim 4, wherein the first supporting member and the second supporting member are formed of polyacetal.

6. The development device according to claim 3, wherein the first supporting member and the second supporting member are formed of polyacetal.

7. The development device according to claim 2, wherein the first supporting member and the second supporting member are formed of polyacetal.

8. The development device according to claim 1, wherein the first supporting member and the second supporting member are formed of polyacetal.

9. The development device of claim 1, wherein the first supporting member includes a first portion supporting the end of the shaft of the development roller and a second portion supporting the end of the regulation member, where the first portion and the second portion are inseparable, and the second supporting member includes a third portion supporting the end of the shaft of the development roller and a fourth portion supporting the other end of the regulation member, where the third portion and the fourth portion are inseparable.

10. An image forming apparatus comprising:

an image holder;

a charging unit that charges the image holder;

an exposure unit that exposes the charged image holder to form a latent image;

a development device that includes:

a development roller that includes a cylindrical member and a shaft, which cylindrical member has a hollow portion through which the shaft is inserted, and the development roller is rotated around an axis, holding a developer containing a toner on a surface of the cylindrical member to supply the toner to the image holder;

a regulation member that is disposed approximately in parallel with the development roller, and regulates a thickness of the toner held on the surface of the cylindrical member;

a first supporting member that supports an end of the shaft of the development roller and an end of the regulation member, wherein the first supporting member is removable from the development device, the first supporting member includes a single member supporting the end of the shaft of the development roller and the end of the regulation member; and a second supporting member that supports another end of the shaft of the development roller and another end of the regulation member, wherein the second supporting member is removable from the development device, the second supporting member includes another single member supporting the other end of the shaft of the development roller and the other end of the regulation member;

a transfer unit that transfers onto a recording medium a toner image formed on the image holder by the toner supplied by the development device; and a fixing unit that fixes the transferred toner image to the recording medium.

11. The image forming apparatus according to claim 10, further comprising:

a transmission unit that includes a shaft, and transmits, by rotating around an axis, torque supplied from a drive unit to the development roller to rotate the development roller, wherein the first supporting member supports an end of the shaft of the transmission unit.

12. The image forming apparatus according to claim 11, further comprising:

a housing that contains the development roller, the regulation member, the first supporting member, the second supporting member, and the transmission unit;

a first wall that is provided between the cylindrical member and the first supporting member in the housing; and a second wall that is provided between the cylindrical member and the second supporting member in the housing, wherein:

the first wall includes a cut out portion in a first area through which the end of the shaft of the development roller passes, a second area through which the end of the regulation member passes, and a space between the first area and the second area; and the second wall includes a cut out portion in a third area through which the other end of the shaft of the development roller passes, a fourth area through which the other end of the regulation member passes, and a space between the third area and the fourth area.

13. The image forming apparatus according to claim 12, further comprising:

a cover that covers the housing from above;

a first protruding unit that protrudes downward from the cover to form a first gap between the first wall and the first protruding unit; and a second protruding unit that protrudes downward from the cover to form a second gap between the second wall and the second protruding unit, wherein:

the first supporting member is inserted into the first gap; and the second supporting member is inserted into the second gap.

14. The image forming apparatus according to claim 10, wherein the first supporting member and the second supporting member are formed of polyacetal.

15. The image forming apparatus of claim 10, wherein the first supporting member includes a first portion supporting the end of the shaft of the development roller and a second portion supporting the end of the regulation member, where the first portion and the second portion are inseparable, and the second supporting member includes a third portion supporting the end of the shaft of the development roller and a fourth portion supporting the other end of the regulation member, where the third portion and the fourth portion are inseparable.

16. A development device comprising:

a development roller that includes a cylindrical member and a shaft , which cylindrical member has a hollow portion through which the shaft is inserted, the development roller being rotated around an axis and holding a developer containing a toner on a surface of the cylindrical member to supply the toner to an image holder;

a regulation member that is disposed approximately in parallel with the development roller, and that regulates a thickness of the toner held on the surface of the cylindrical member;

a first supporting member that supports an end of the shaft of the development roller and an end of the regulation member;

a second supporting member that supports another end of the shaft of the development roller and another end of the regulation member;

a housing that contains the development roller, the regulation member, the first supporting member, and the second supporting member;

a first wall that is provided between the cylindrical member and the first supporting member in the housing; and a second wall that is provided between the cylindrical member and the second supporting member in the housing, wherein:

the first wall includes a cut out portion in a first area through which the end of the shaft of the development roller passes, a second area through which the end of the regulation member passes, and a space between the first area and the second area; and the second wall includes a cut out portion in a third area through which the other end of the shaft of the development roller passes, a fourth area through which the other end of the regulation member passes, and a space between the third are and the fourth area.

17. An image forming apparatus comprising:

an image holder;

a charging unit that charges the image holder;

an exposure unit that exposes the charged image holder to form a latent image;

a development device that includes:

a development roller that includes a cylindrical member and a shaft, which cylindrical member has a hollow portion through which the shaft is inserted, the development roller being rotated around an axis and holder a developer containing a toner on a surface of the cylindrical member to supply the toner to the image holder;

a regulation member that is disposed approximately in parallel with the development roller, and that regulates a thickness of the toner held on the surface of the cylindrical member;

a first supporting member that supports an end of the shaft of the development roller and an end of the regulation member;

a second supporting member that supports another end of the shaft of the development roller and another end of the regulation member;

a housing that contains the development roller, the regulation member, the first supporting member, and the second supporting member;

a first wall that is provided between the cylindrical member and the first supporting member in the housing; and a second wall that is provided between the cylindrical member and the second supporting member in the housing, wherein:

the first wall includes a cut out portion in a first area through which the end of the shaft of the development roller passes, a second area through which the end of the regulation member passes, and a space between the first area and the second area; and the second wall includes a cut out portion in a third area through which the other end of the shaft of the development roller passes, a fourth area through which the other end of the regulation member passes, and a space between the third area and the fourth area;

a transfer unit that transfers onto a recording medium a toner image formed on the image holder by the toner supplied by the development device; and a fixing unit that fixes the transferred toner image to the recording medium.

* * * * *